US006121853A

United States Patent [19]

London

[11] Patent Number: 6,121,853

[45] Date of Patent: Sep. 19, 2000

[54] BROADBAND COUPLED-LINE POWER COMBINER/DIVIDER

[75] Inventor: Simon Y. London, Rockville, Md.

[73] Assignee: Apti, Inc.

[21] Appl. No.: 09/181,441

[22] Filed: Oct. 28, 1998

[51] Int. Cl.[7] ..... H01P 5/12

[52] U.S. Cl. ..... 333/125; 333/127; 333/128; 333/136

[58] Field of Search ..... 333/125, 127, 333/136, 128, 109, 115, 116, 117

[56] References Cited

U.S. PATENT DOCUMENTS 5,789,996 8/1998 Borodulin ..... 333/117

*Primary Examiner*—Robert Pascal
*Assistant Examiner*—Kimberly E Glenn
*Attorney, Agent, or Firm*—Rossi & Associates

[57] ABSTRACT

A broadband coupled-line N-way power combiner is presented for combining N RF signals into a common load. This combiner includes N≧2 input ports, a common output port, and N identical at least two-conductor coupled transmission lines, and N isolating resistors. Each of these two-conductor coupled transmission line has at one end one conductor connected to one of the input port of the power combiner, and another conductor connected to the common output port. At another end two conductors of each two-conductor coupled transmission line are terminated to one of the N isolating resistors. The opposite ends of these resistors are connected to each other in a ring. This power combiner also can operate in reverse as N-way power divider.

6 Claims, 11 Drawing Sheets

BROADBAND COUPLED-LINE POWER COMBINER/DIVIDER

FIELD OF INVENTION

The present invention relates in general to power combiners/dividers. More specifically, the invention relates to power combiners/dividers of a coupled transmission line (quarter-wavelength) type that enables significant increases in operating bandwidth.

DESCRIPTION OF THE PRIOR ART

Power combiners/dividers are essential subsystems in modern communication, HDTV and other systems, and play a major role in solid-state power amplifiers to achieve the specific output power. The necessary bandwidth of systems is permanently increasing, but on the other side the insertion loss and cost of power combiners should be minimized. There are two principal different technologies, which currently provide broadband power combining/dividing with isolation between ports, namely, transformer-type devices, usually with ferrite cores, to realize multi-octave bandwidth by providing RF isolation of their main operating conductors from ground, and quarter-wavelength (or multiple quarter-wavelength) devices without ferrite materials, where common ground is one of the operating conductors. The latter category of power combiners/dividers has, practically, significantly less bandwidth due to resonance properties of lines. On the other hand, these devices in most cases are much better for implementation in VHF-UHF bands and extension of their operating bandwidth remains still the open problem.

There are several main parameters that should be achieved simultaneously in broad band: low inputs/output voltage standing wave ratio (VSWR), high isolation between ports, small magnitude and phase unbalance in transfer characteristics, low insertion loss, acceptable complexity and size, high reliability and low cost. One example of a known power combiner/divider is the Wilkinson power divider (See, E. J. Wilkinson, "An N-Way Hybrid Power Divider", *IRE Transaction on Microwave Theory Tech.,* vol. MTT-8, pp. 116–118, Jan. 1960; and S. Y. London, "Independent Operation of High Power VHF-Amplifiers on Common Load", *Problems of Radio-Electronics,* ser. 10, vol. 6, pp. 87–97, 1959, USSR). This device provides N-way equal power combining or dividing at relatively low bandwidth of about one octave. A known way of extending bandwidth is to increase the number of sections in combiner/divider (See, Harlan Howe, J. R.: "Stripline Circuit Design", Artech House, Inc., 1974, Ch.3). For an N-way M-section power combiner/divider, N×M transmission lines and N×M isolating resistors if N>2 and M resistors for N=2 in the common case.

In cases when N>3 and M>2 (for achieving broad band) the real design becomes very complicated. Further, for M>1 the isolating resistors have non-standard and different values of resistance in sections. In addition, for this type of power combiners the isolating resistors are "floating" and connected directly to the "body" of combiner. The latest disadvantage can be excluded by using additional transmission lines in various configurations (See, S. Y. London: "Power Combiner of Several Amplifiers", USSR Patent No. 132674, 1960; U. H. Gysel: "A New N-Way power Divider/Combiner Suitable for High-Power Applications", *MIT Symposium Digest,* 1975 pp. 116–118; T. I. Frederick et al., "High Power Radio Frequency Divider/Combiner", U.S. Pat. No. 5,455,546; R. J. Blum, "Microwave High Power Combiner/Divider", U.S. Pat. No. 5,410,281. However, such improvements are practically reasonable only for one-section combiners/dividers with relatively low bandwidth of about one octave.

Operating bandwidth of the above-described in-phase power combiners may be increased up to two octaves by using additional LC-correction elements, as has been shown by Arie Shor: "Broadbanding Techniques for TEM N-Way Power Divider," 1988 MTT-S Digest pp. 657–659. However, this way of extending bandwidth implies increasing insertion losses and complexity.

One effective way to increase bandwidth of considered in-phase power combiners is to use coupled transmission lines (See, Europaische Patentaneldung, No. 0 344 458 A1, 1989). In U.S. Pat. No. 5,543,762, a simple one-section coupled-line structure is described in which the achieved bandwidth is less than two octaves for any built-in impedance transformation ratio in the combiner. However, if the required bandwidth is two octaves or more, it is impossible to realize acceptable isolation between ports as well as impedance transformation in known one-section structure, and a very complicate power combiner should be used independent on value of built-in impedance transformation ratio.

In view of the above, it is an object of the present invention to provide a broadband power combiner.

It is another object of the present invention to provide one-section N-Way power combiner with high isolation between its N outputs at two and more octave bandwidth.

It is still another object of present invention to provide power combiner having high isolation between ports by using only one group of isolating resistors.

It is still another object of present invention to provide power combiner having low inputs and output voltage standing wave ratio.

It is a further object of the present invention to provide N-Way power combiner having a symmetrical configuration with respect to its inputs to avoid phase and amplitude imbalances.

It is a further objective of the present invention to provide a power combiner using well-known technology.

It is still a further objective of the present invention to provide a power combiner using standard values of isolating resistance, 50-Ohms in the case of 50-Ohms nominal input impedance of the power combiner.

SUMMARY OF THE INVENTION

In the present invention, significant effort in extending bandwidth or in simplifying multi-octave power combiner may be attained if functions of isolation between ports and impedance transformation (when necessary) are separate, i.e. a power combiner with full built-in impedance transformation is not used. A high isolation between ports in the bandwidth up to three octaves can be achieved in a simple one-section N-Way power combiner with only one group of N isolating resistors. Then the additional impedance transformer at the output of combiner should be used when necessary. This transformer will be much simpler than realization of built-in transformation in multi-section combiner because there are no specific restrictions on its structure and element values. Not only stepped quarter-wavelength structure may be used. Further, in a two-section power combiner in accordance to present invention a decade and more bandwidth may be achieved. In a more limited bandwidth a full built-in impedance transformation also may be implemented.

BRIEF DESCRIPTION OF THE DRAWINGS

The invention will be described in detail with reference to certain preferred embodiments thereof and the accompanying drawings, wherein.

DETAILED DESCRIPTION OF THE PREFERRED EMBODIMENTS

Figure 1:
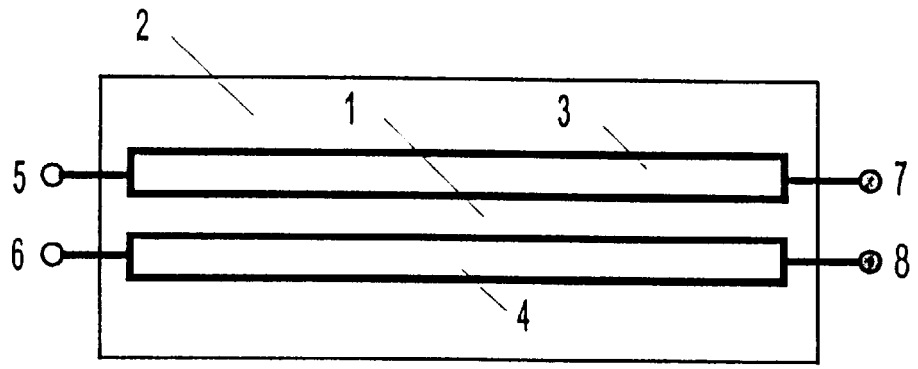
FIG. 1 ( Prior Art)
FIG. 1 illustrates a prior art circuit that is structure of a two coupled transmission lines having third conductor as a common "ground" plate, and in the particular case of two identical lines this structure is a widely used 3-dB coupler.

Referring first to FIG. 1, prior art two-conductor coupled transmission lines is indicated generally by number 1. The first line has one conductor 3 and common ground 2 as a second conductor of this line. The second line has one conductor 4 and a common ground 2 as a second conductor of this line. Both lines have equal length and may have equal or different characteristic impedances. Four unbalanced ports of this structure are 5, 6, 7, and 8. If in a particular case both lines are identical, they form matched directional coupler. At a central frequency of this coupler, the electrical length of each line is equal 90 deg. The nominal impedance, the same at each port 5, 6, 7, 8, and coupling ratio are determined by coupling coefficient between lines and their characteristic impedance. If coupling coefficient is equal 0.707, a standard 3-dB coupler is provided.

Figure 2:
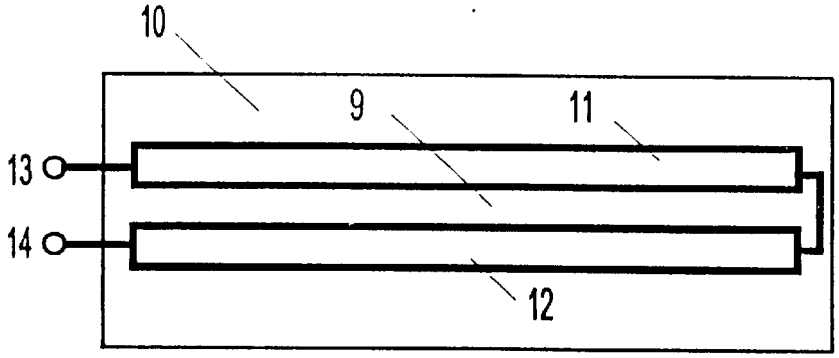
FIG. 2 ( Prior Art)
FIG. 2 illustrates meander transmission line that can be obtained from FIG. 1 if at the one side of this coupler both conductors are connected together, and in this case there is known matched two-port or phase shifter.

When two adjacent matched ports (5 and 6) or (7 and 8) of coupler FIG. 1 are connected, a matched two-port without impedance transformation known as a meander transmission line phase shifter is obtained as shown on FIG. 2. The unsymmetrical meander transmission line can operate as impedance transformer at a limited frequency band, as have been shown by Edward G. Cristal in: "Meander-Line and Hybrid Meander-Line Transformers", *IEEE Trans. MTT,* vol.21, February 1993, No.2 pp. 69–75). Instead of a two-conductor coupled transmission line, a multi-conductor transmission line may be used as phase shifter or impedance transformer with extended bandwidth.

Figure 3:
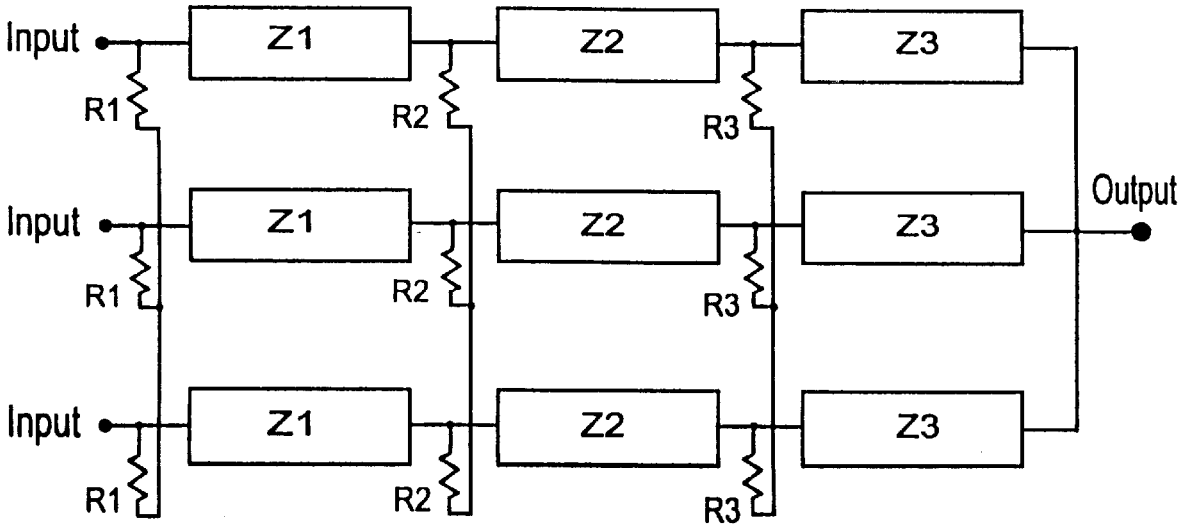
FIG.3 ( Prior Art)
FIG. 3 illustrates the prior art circuit that is three-way three-section Wilkinson power combiner.

Referring to FIG. 3, there is schematic of three-section three-way Wilkinson power combiner. It has three inputs, one output, and three groups of lines. Each group consists of three lines in one section with equal characteristic impedance. There are three groups of isolating resistors. All three resistors in one section are identical. The values of characteristic impedance Z1, Z2 and Z3 as well as values of resistors R1, R2 and R3 are determinate by bandwidth ratio of combiner and built-in impedance transformation.

Figure 4:
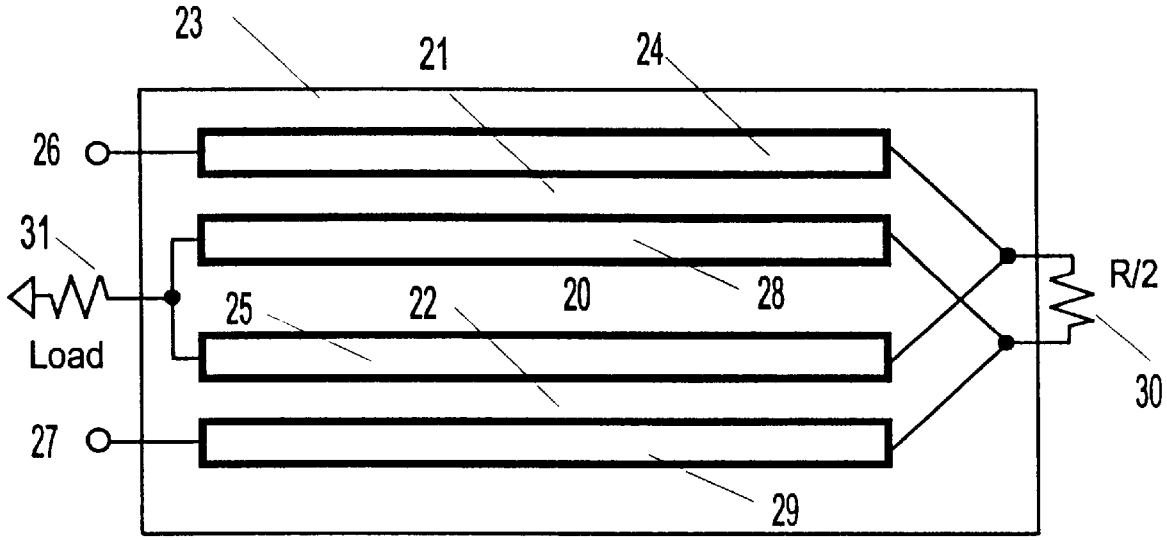
FIG. 4 illustrates the schematic diagram of one-section two-way power combiner according to a preferred embodiment of the present invention.

Referring now to FIG. 4, one of the possible versions of two-way power combiner in accordance to the present invention is shown. The combiner 20 has two identical two-conductor coupled transmission lines 21 and 22 with respect to common ground 23. First ends of conductors 24 and 29 at one side of the coupled transmission lines 21 and 22 are connected to inputs terminals 26 and 27 correspondingly. At the same side, first ends of the conductors 28 and 25 are connected together to an unbalanced load 31. At the opposite side of the transmission lines 21 and 22, a second end of the conductor 24 is connected to a second end of conductor 25 and to one terminal of an isolating resistor 30. On this same side of the transmission lines, a second end of the conductor 28 of transmission line 21 is connected to a second end of conductor 29 of the transmission line 22 and to a second terminal of isolating resistor 30.

Consider for simplicity the case when both identical pairs of coupled transmission lines 21 and 22 are symmetrical. In operating in-phase mode two equal-phase and equal-magnitude RF signals are applied to input ports 26 and 27. In this case of excitation the voltage at isolating resistor is equal zero and this resistor can be short-circuited. Consequently, for each of two inputs of schematic FIG. 4 a known circuit shown on FIG. 2 is provided in which the source is connected between terminal 13 and ground. The load 31 with double value of impedance is connected between terminal 14 and ground. If, for example, the parameters of each pair of coupled transmission lines is chosen as for 3-dB typical 50 Ohm coupler, non-reflected 50 Ohm input impedance independent on frequency is provided, namely, the reflection coefficient $S_{++}=0$ at even mode excitation at ports 26 and 27. This reflection coefficient $S_{++}$ may be equal zero for any coupling coefficient between lines in each pair. The value of coupling coefficient should be optimized for maximum isolation between input ports 26 and 27 of combiner 20.

Isolation between ports 26 and 27 due to symmetry of combiner may be define as $a_{dB}=20 \log |S_{++}+S_{+-}|^{-1}$; $S_{+-}$ is reflection coefficient at ports 26 and 27 for odd mode of excitation, when equal magnitude and out-of phase signals are applied at ports 26 and 27 with respect to common ground 23.

Figure 5:
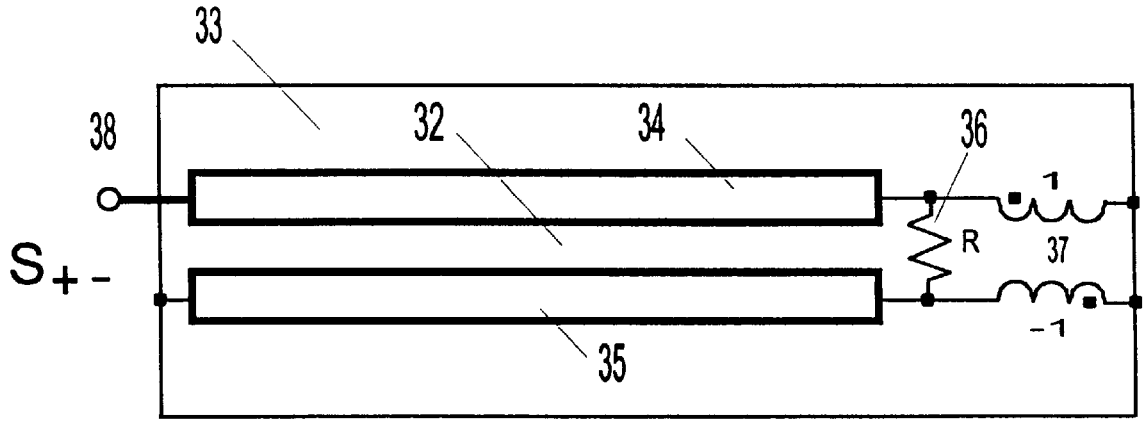
FIG. 5 illustrates the schematic for each input of FIG. 4 by the odd mode excitation, i.e. when equal-magnitude and out-of phase signals are applied to two input ports of FIG. 4.

For this mode of excitation, the output of the combiner can be connected to ground, i.e., load 31 should be short-circuited. Corresponding schematic diagram for odd mode of excitation is shown in FIG. 5. In this figure, the pair of coupled lines 32 with conductors 34, 35 and common ground 33 is the pair of lines 21 or 22 in FIG. 4. Resistor 36 has twice the value of resistance with respect to resistor 30 on FIG. 4. An ideal transformer 37 with a 1: −1 transformation ratio (phase reversed) is necessary due to cross-connection of conductors of coupled lines 21 and 22 at the side of resistor 30.

If at operating in-phase mode (even-mode) excitation, as shown above, input reflection coefficient is $S_{++}=0$, the isolation between inputs 26 and 27 of combiner FIG. 4 is equal $a_{dB}=2 \log |S_{+-}|^{-1}$ and defined only by circuit FIG. 5 at port 38. For appropriate combinations of coupling coefficient between lines and resistance of resistor 36 the circuit FIG. 5 has low reflection coefficient $S_{+-}$ in wide frequency band. Therefore, the combiner FIG. 4 may be broadband, as will be shown below.

Figure 6:
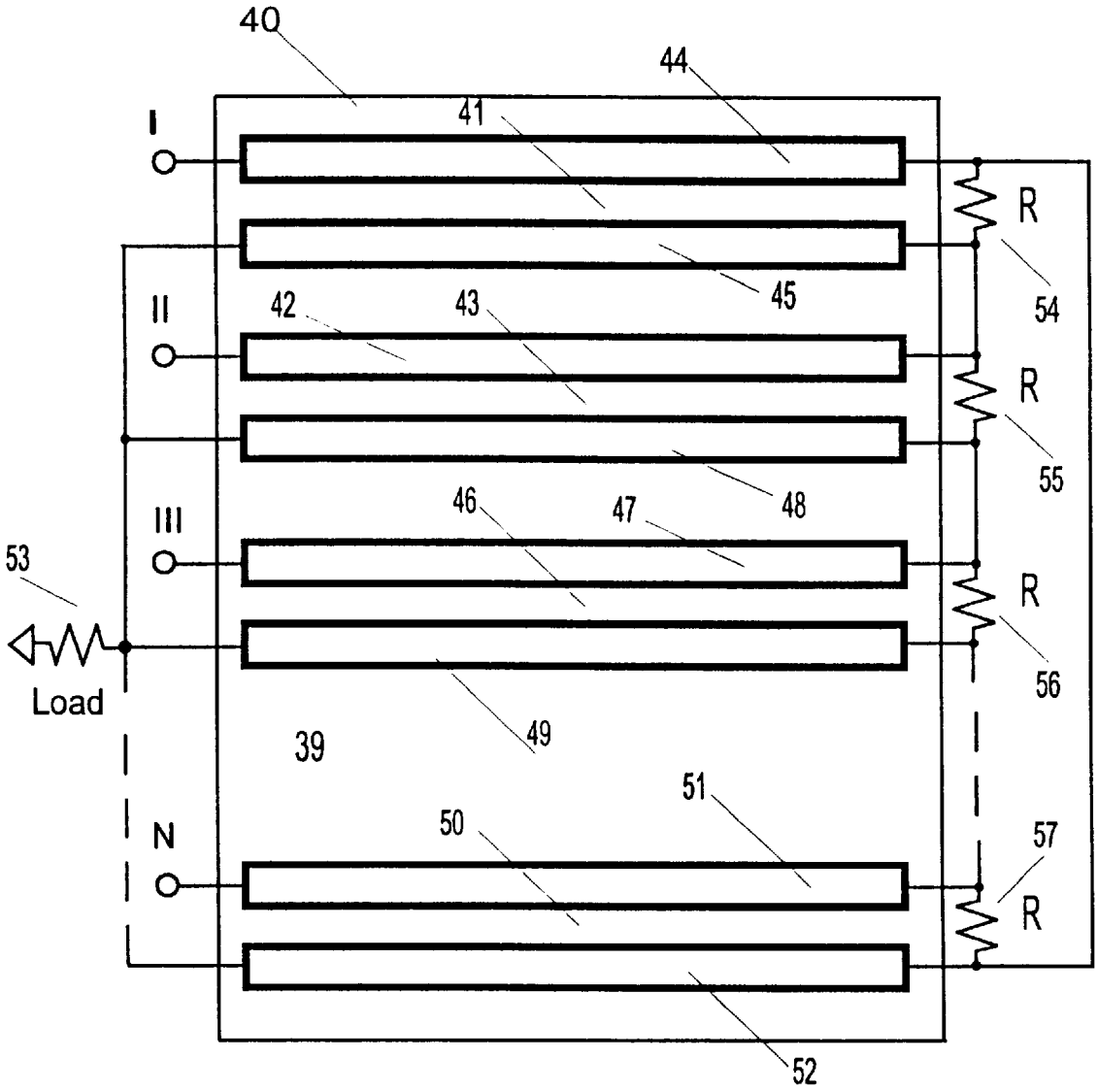
FIG. 6 illustrates a schematic of one-section N-Way power combiner according to preferred embodiment of the present invention.

A simple one-section N-Way power combiner 39 is shown on FIG. 6. It consists of N identical pairs of two-conductor coupled transmission lines, and only four of them are shown: 41, 43, 46 and 50 with respect to common ground 40. Each pair of coupled transmission lines incorporate two conductors: 44 and 45 for line 41, 42 and 48 for line 43, 47 and 49 for line 46, 51 and 52 for line 50. The first conductors 44, 42, 47 and 51 at one side of the lines are connected to one of the input terminals I, II, III . . . N correspondingly. All second conductors at the same side of lines are connected together to the common output port with load impedance 53. At the opposite side of the lines, each pair of conductors (44 and 45, 42 and 48, 47 and 49, 51 and 52) are terminated at the individual resistors 54, 55, 56 and 57 correspondingly. Further, the end of second conductor 45 of first pair of coupled lines 41 is connected to the end of first conductor 42 of the second pair of coupled lines 43. The end of the second conductor 48 of second pair of coupled lines 43 is connected to the end of the first conductor 47 of the third pair of coupled lines 46 and so on. The end of the second conductor 52 of last pair of coupled lines 50 ($N^{th}$ pair) is connected to the end of the first conductor 44 of the first pair of coupled lines 41.

In operating mode, i.e. when there are N in-phase and equal-magnitude radio-frequency sources at all N inputs the full their power will be dissipated in the common load 53. Corresponding equivalent circuit for this mode is the same as for one-section two-way combiner FIG. 4 and was shown on FIG. 2. Accordingly, the matching conditions for all N generators at input ports I, II, III . . . N can be fulfilled at operating mode.

For calculation of the isolation between inputs, the additional N−1 equal-magnitude and equal phase-spread modes of excitation with corresponding circuits like FIG. 5 and then the principle of superposition may be used. Another way is by direct computer calculation and optimization procedure for combiner schematic as whole. In any case due to symmetry property of combiner's circuit the isolation is different only between different relative oriented ports.

Figure 7A:
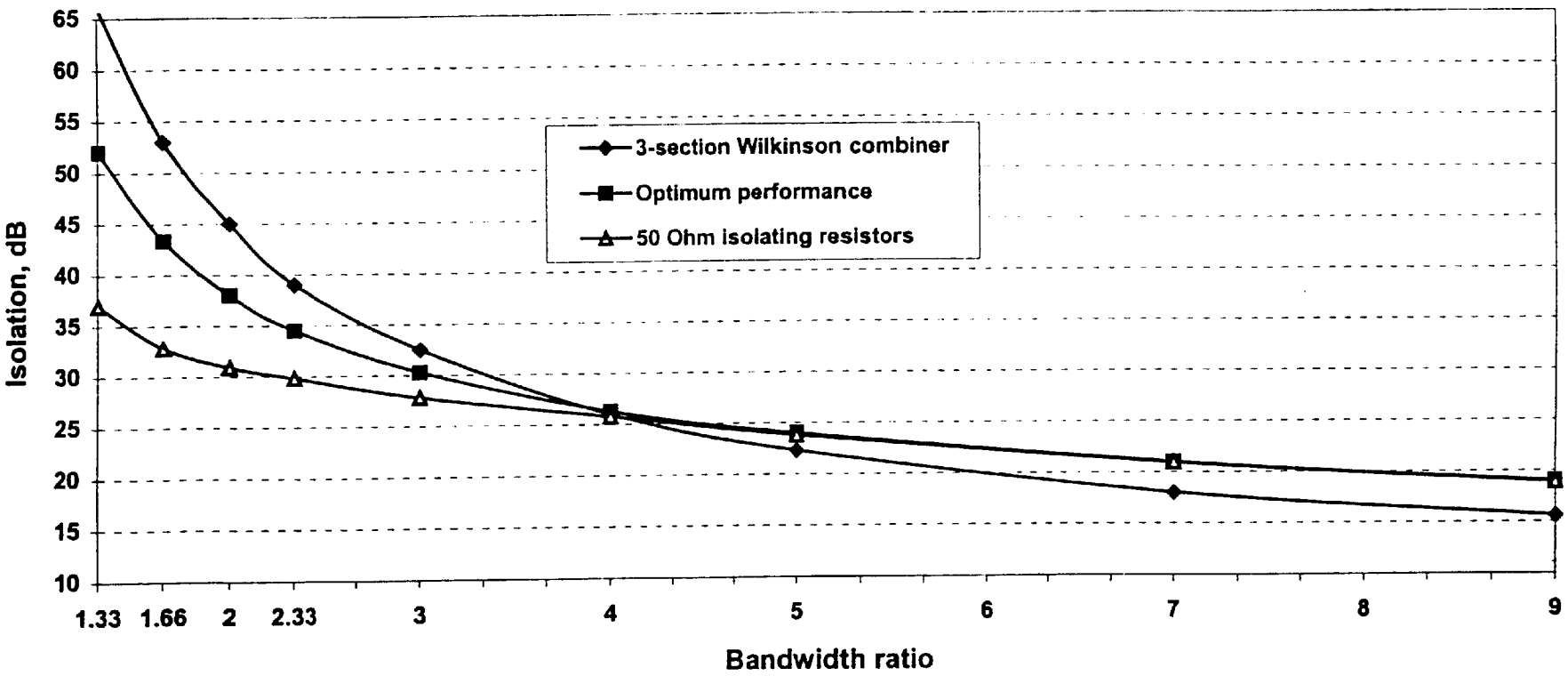
FIG. 7*a* illustrates isolation between inputs vs. bandwidth ratio for two-way combiner shown on FIG. 4 in comparison to isolation between ports of two-way three-section Wilkinson combiner.

Now consider some results of numerical calculations. Referring to FIG. 7*a,* the results of calculation for one-section two-way combiner FIG. 4 in the case when value of load resistance 31 is one halve of nominal input impedance at ports 26 and 27 is shown Two different conditions are considered: optimum performance, but non-standard values of isolating resistor (optimum values R in the range ≈46 . . . 66 Ohm); and standard value R=50 Ohm.

Figure 7B:
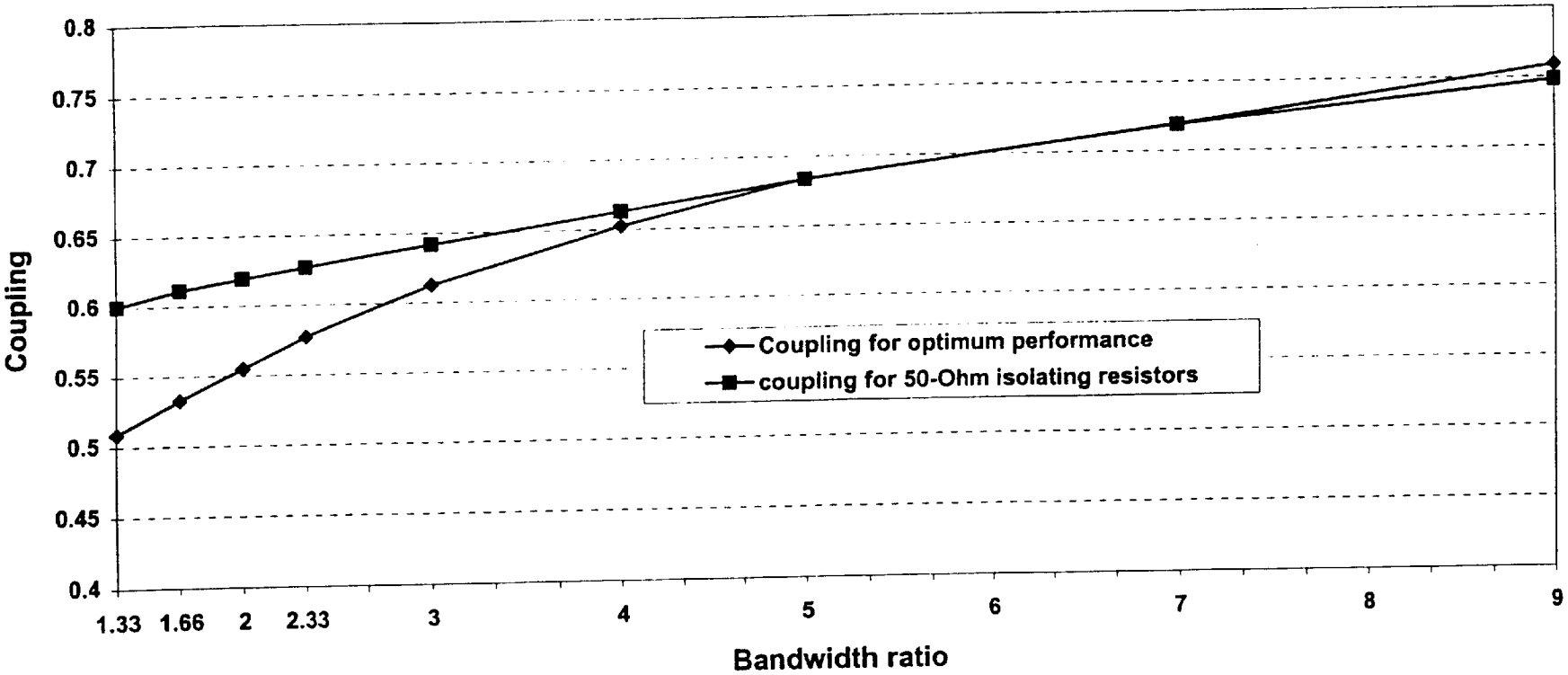
FIG. 7*b* illustrates the dependence of coupling coefficient for each pair of lines vs. bandwidth ratio for two-way combiner FIG. 4.
Figure 8A:
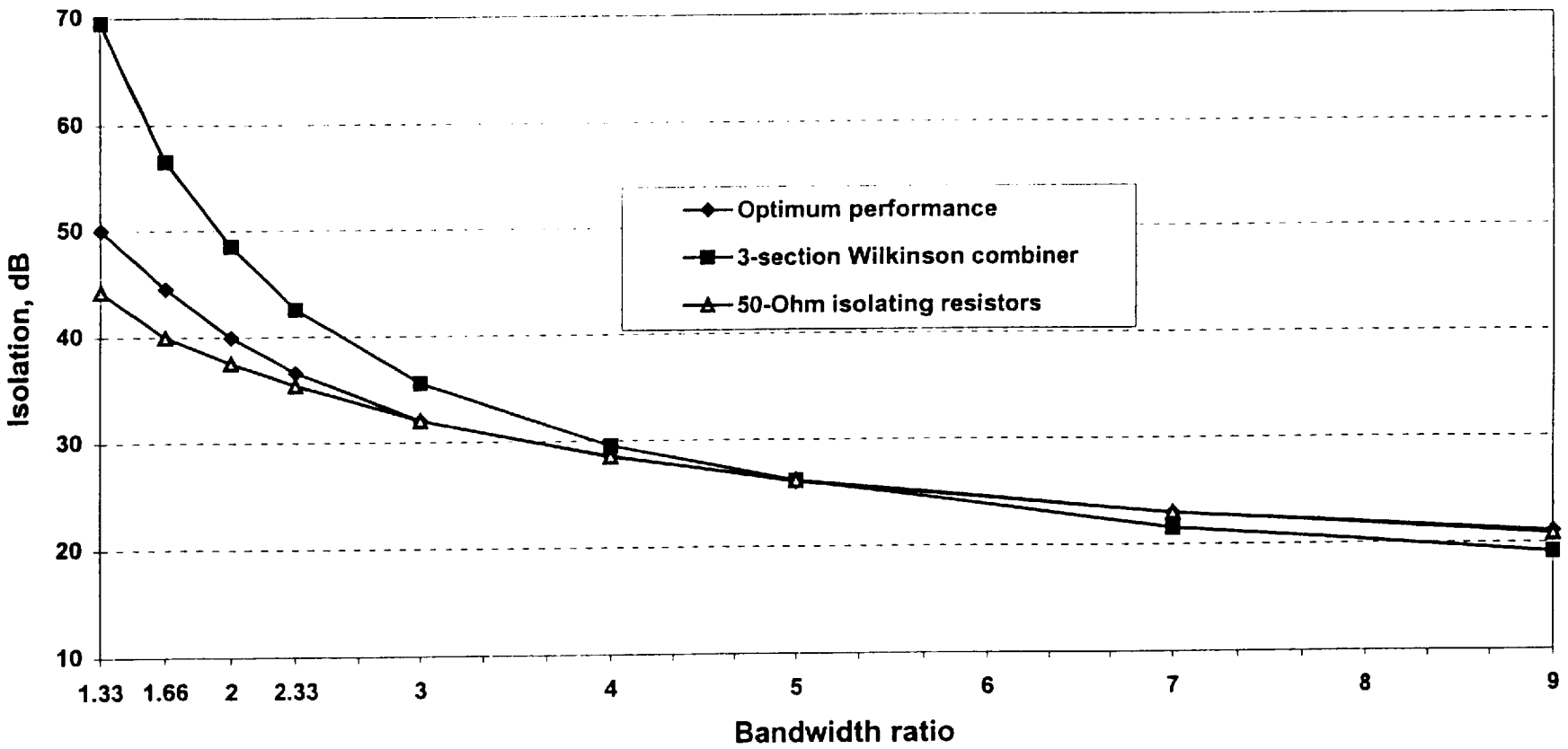
FIG. 8*a* illustrates isolation between inputs vs. bandwidth ratio for one-section three-way combiner according to a preferred embodiment of the present invention in comparison to isolation between ports of three-way three-section Wilkinson combiner that is shown in FIG. 3.
Figure 8B:
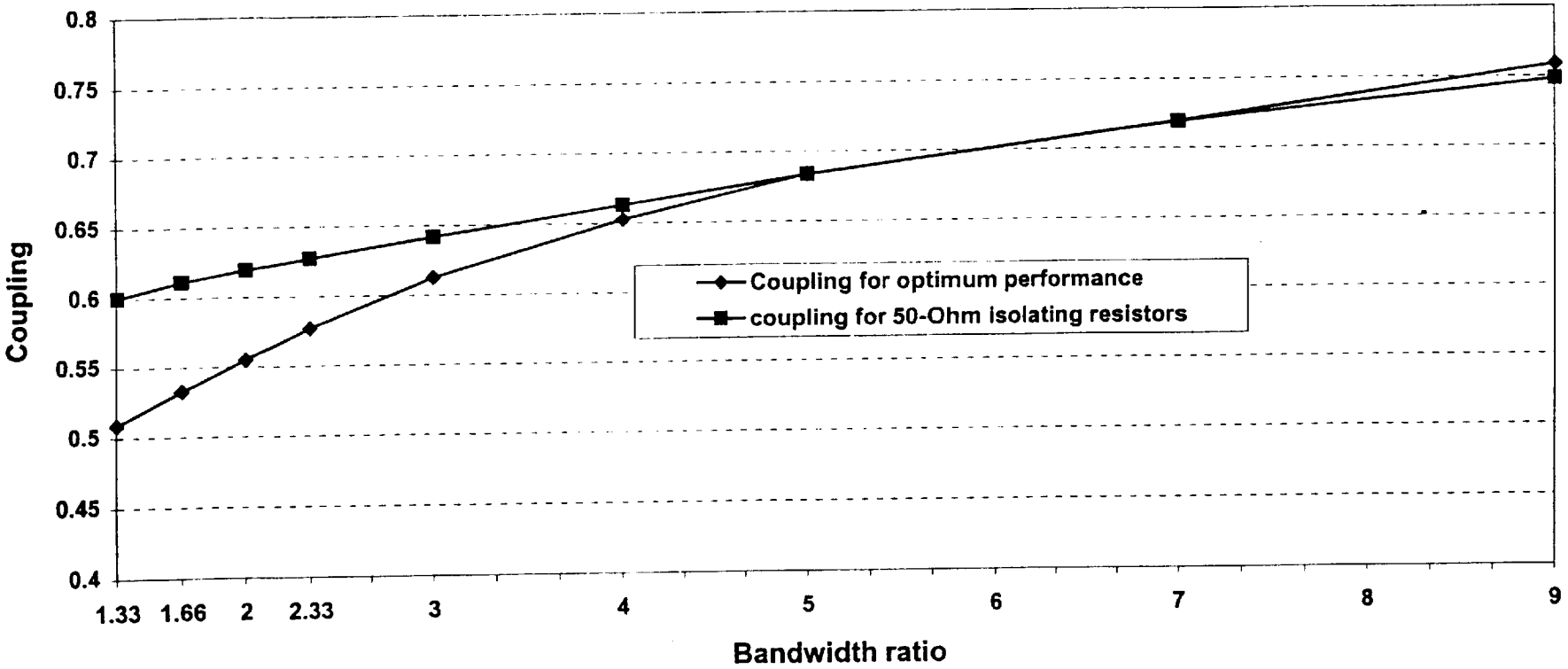
FIG. 8*b* illustrates the dependence of coupling coefficient for each pair of coupled lines vs. bandwidth ratio for one-section three-way combiner according to a preferred embodiment of the invention.

For comparison the values of isolation for three-section two-way Wilkinson combiner are presented for the same load impedance. As can be seen, for a more important lower isolation when bandwidth ratio is four and more the combiner in accordance to present invention has greater isolation. FIG. 7*b* shown the values of corresponding coupling coefficients for each pair of coupled lines. The same results of calculation for one-section three-way combiner in comparison to three-section three-way Wilkinson combiner of FIG. 3 are shown on FIG. 8*a* and FIG. 8*b*. As a result, in accordance with the invention, independent on frequency input impedance (50 Ohm, for example) at operating mode, and isolation between inputs not less then 20 dB at bandwidth ratio up to 8:1 for one-section two-and three ways combiners is provided. Accordingly, significant effect in increasing bandwidth ratio is achieved with respect to known one-step power combiners.

Figure 9:
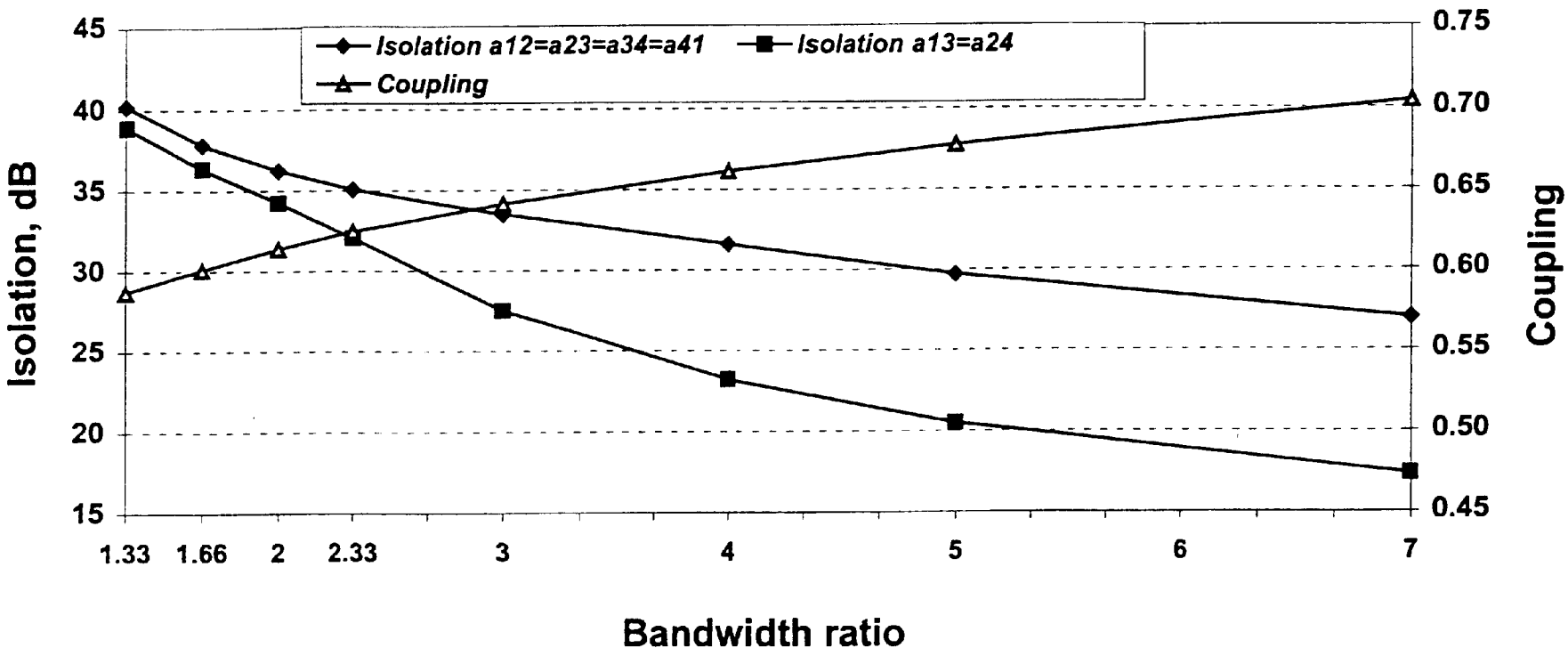
FIG. 9 illustrates isolation between inputs and coupling coefficient vs. bandwidth ratio for one-section four-way combiner according to a preferred embodiment of the present invention.

The results of calculation for one-section four-way combiner in accordance to present invention is shown on FIG. 9, and also illustrates that the bandwidth ratio is substantially more than for two-section Wilkinson combiner. If the meander line according to FIG. 2, which implements the operating mode equivalent circuit of one-section N-way power combiner, has built-in impedance transformation, the operating bandwidth will be decreased. An effective way for increasing bandwidth is to use additional impedance transforming transmission line. This line in combination with built-in impedance transformation in combiner's coupled transmission lines operates as optimum impedance transformer for operating mode.

Figure 10A:
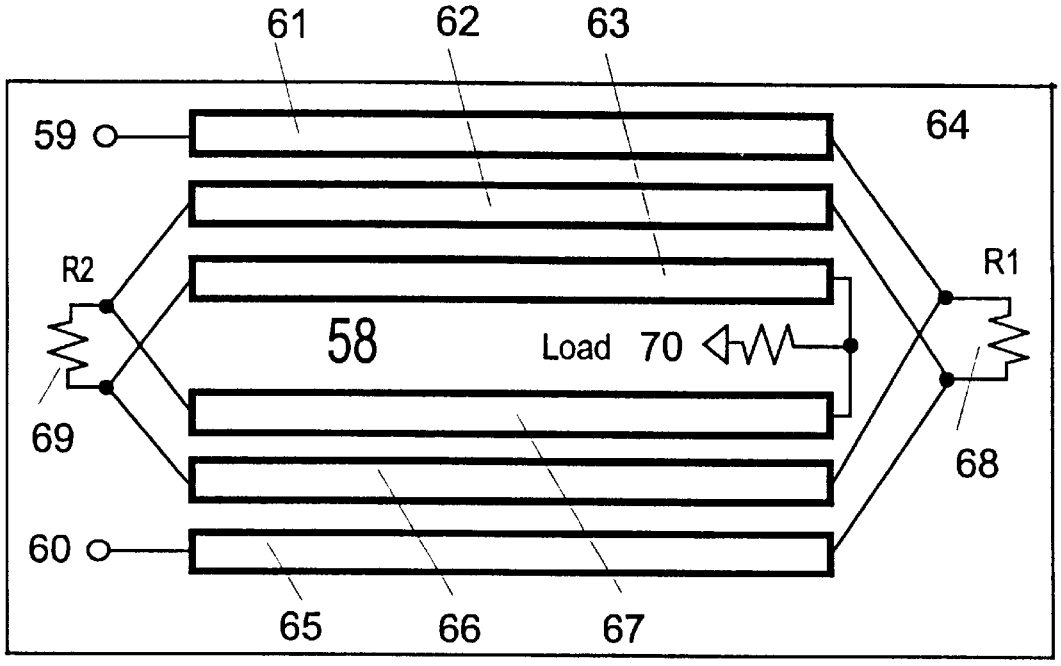
FIG. 10*a* illustrates a schematic of a two-section two-way combiner in accordance to present invention.

For further increasing bandwidth with or without built-in impedance transformation the two-or more-section combiners can be used. Referring now to FIG. 10*a,* one embodiment of the two-section two-way combiner 58 in accordance to present invention is shown. It consists of two input ports 59, 60 and two identical three-conductor transmission lines. A first transmission line has conductors 61, 62 and 63 with respect to common ground 64. A second transmission line consists of three conductors 65, 66 and 67 also with respect to common ground 64. All interconnections between conductors at both sides of the transmission lines are in symmetrical manner. There are two isolating resistors 68, 69 and a load 70. For this type of combiner, various combinations of line's parameters, including coupling between lines may be realized to achieve match for operating even mode, i.e., $S_{++}=0$. The bandwidth ratio 10:1 can be achieved with isolation greater than 20 dB.

Figure 10B:
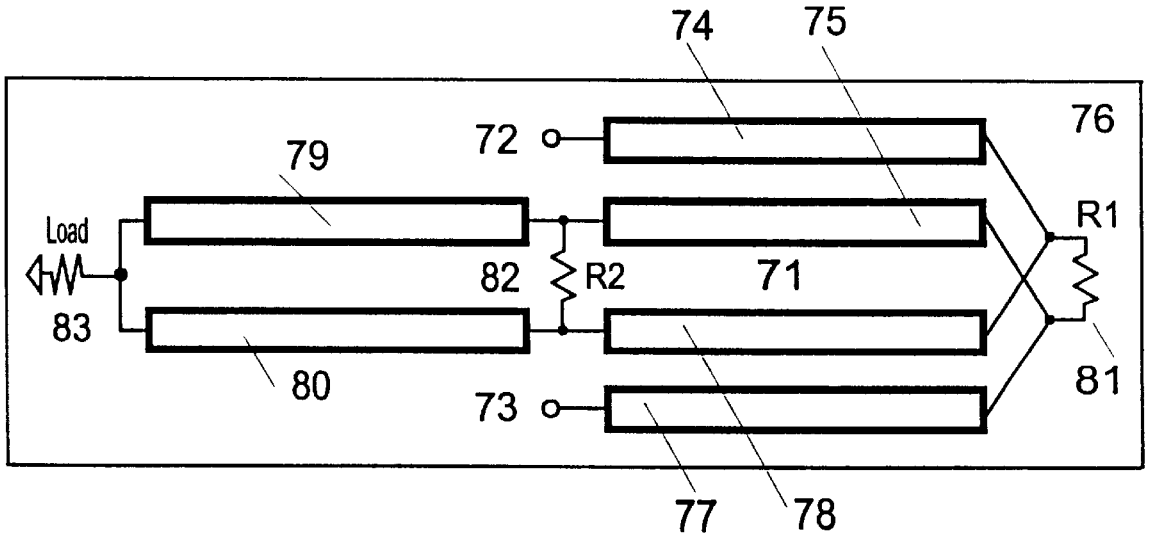
FIG. 10*b* illustrates a schematic of another two-section two-way combiner in accordance to present invention.

Another version of a combiner in accordance with the invention is shown in FIG. 10*b*. This combiner consists of a structure of one-section two-way combiner 71 with two input ports 72, 73, two additional identical uncoupled lines 79, 80 connected to the load 83 and one additional isolating resistor 82. In this design also bandwidth ratio 10:1 can be achieved and isolation greater than 20 dB.

Figure 11A:
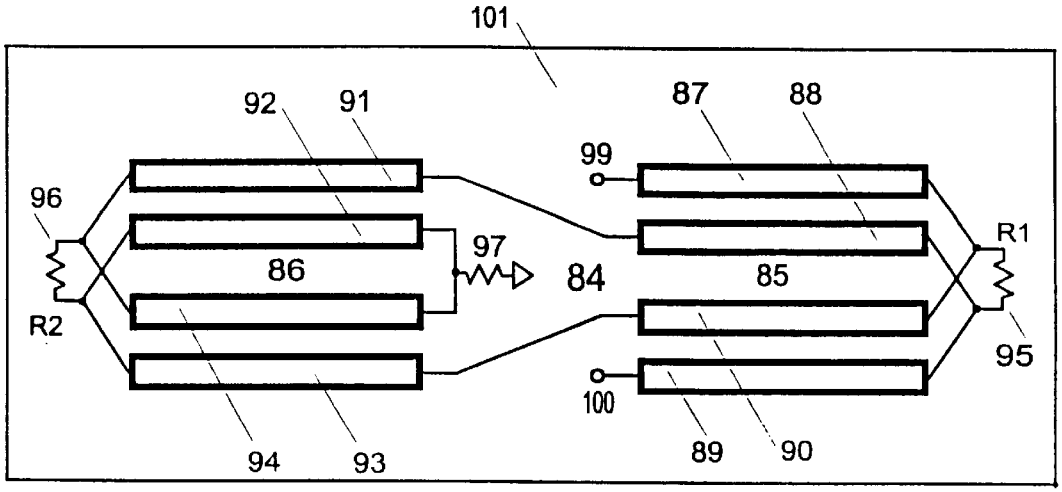
FIG. 11*a* illustrates a schematic of a third two-section two-way combiner in accordance with the present invention.

The third version of two-way two-section combiner with the invention is shown in FIG. 11*a*. This combiner 84 consists of sections 85 and 86. The first one consists of two pairs of coupled lines with conductors 87 and 88, in one pair, and conductors 89 and 90 in another pair. The second section consists of coupled lines with conductors 91 and 92, and coupled lines with conductors 93 and 94. First section has input ports 99 and 100, and the second section includes load 97 with respect to common ground conductor 101 for all lines. Besides, the first section includes isolating resistor 95, and the second section includes isolating resistor 96. Both chain-connected sections 85 and 86 have the same structure as combiner FIG. 4.

Figure 11B:
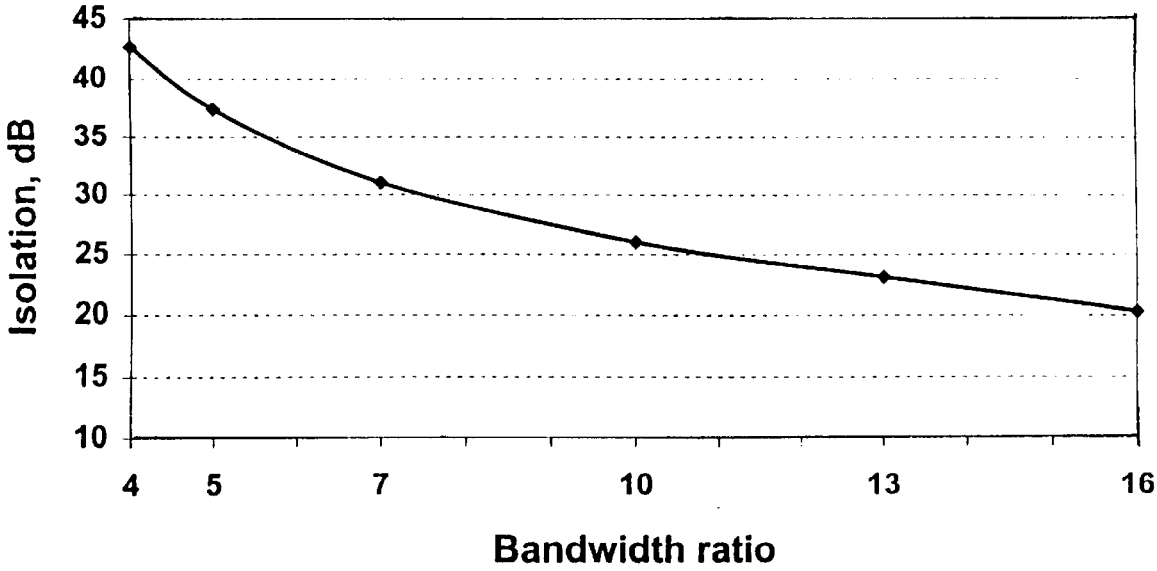
FIG. 11*b* illustrates isolation between inputs vs. bandwidth ratio for two-section combiner shown on FIG. 11*a;*

One of the calculated characteristic of isolation between ports 99 and 100 for the case when load impedance 97 is half of the value of each input impedance ($S_{++}$=0), and each pair of coupled lines corresponds 3-dB coupler is shown on FIG. 11*b*. Bandwidth ratio 15:1 is achieved. The corresponding values of isolating resistors are R1=115 Ohm, R2=29 Ohm.

Figure 12:
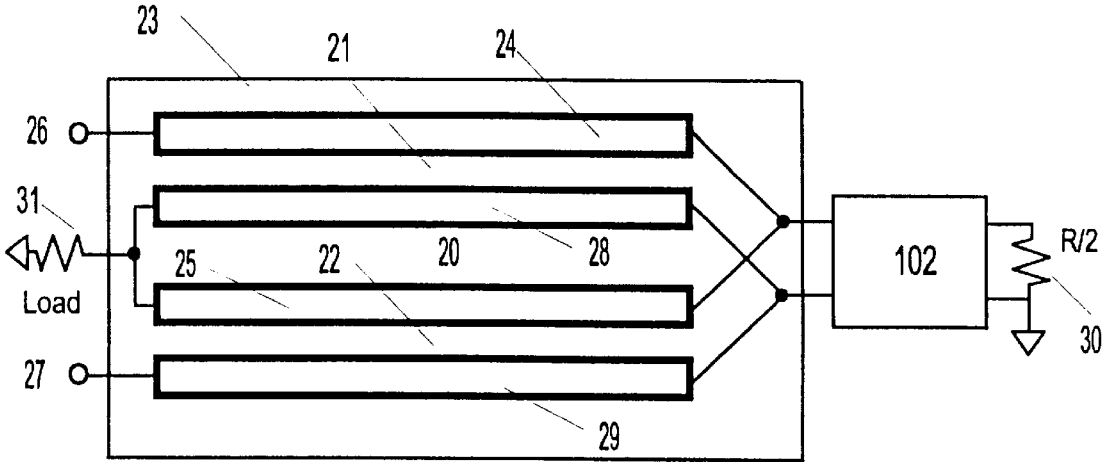
FIG. 12 illustrates the preferred embodiment of one-section two-way power combiner with additional balun transformer for isolating resistor.

For realizing unbalanced isolating resistor and to form hybrid from one-section two-way combiner additional balun transformer may be used as shown on FIG. 12. Balun transformer 102 connected between unbalanced isolating resistor 30 and interconnected conductors of coupled lines 21 and 22.

Figure 13:
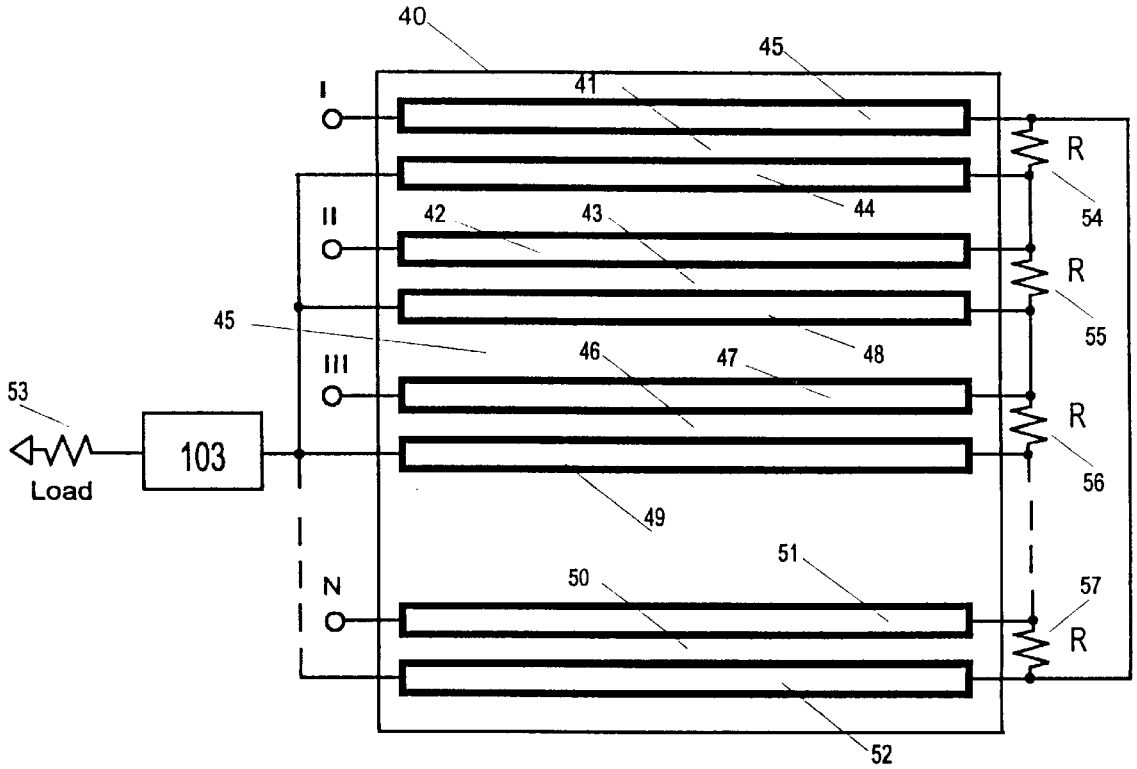
FIG. 13 illustrates the preferred embodiment of one-section N-Way power combiner in accordance to present invention with additional impedance transformer at the output.

For additional impedance transformation a separate transformer should be used as shown on FIG. 13 for one-section N-way combiner. The structure of this transformer 103 may be independent on the structure of combiner. A broadband transmission-line transformer it may be preferable to use instead of long length stepped quarter-wavelength type. The invention has been described with reference to certain preferred embodiments thereof, it will be understood, however, modifications are possible within the scope of the appended claims.

What is claimed is:

1. An apparatus comprising:

first and second two-conductor coupled transmission lines, wherein each transmission line includes first and second conductors;

first and second input terminals; and an isolating resistor;

wherein a first conductor of said first transmission line is coupled at a first end to said first input terminal and at said second end to a first input of said isolating resistor, a first conductor of said second transmission line is coupled at said first end to said second input terminal and at a second end to a second input of said isolating resistor; and wherein said second conductor of said first transmission line is coupled at a first end to a load and at said second end to said second input of said isolating resistor, and a second conductor of said second transmission line is coupled at a first end to said load and at a second end to said first input of said isolating resistor.

2. An apparatus as claimed in claim 1, wherein said second conductor of said first transmission line is coupled to said load via a first uncoupled conductor, said second conductor of said second transmission line is coupled to said load via a second uncoupled conductor, and a second isolating resistor is provided across inputs of said first and second uncoupled conductors.

3. An apparatus as claimed in claim 1, wherein said first and second transmission lines, said first and second input terminals and said isolating resistor comprise a first combiner section, and wherein said second conductor of said first transmission line and said second conductor of said second transmission line are coupled to said load via a second combiner section.

4. An apparatus as claimed in claim 3, wherein the second combiner section includes:

first and second two-conductor coupled transmission lines, wherein each transmission line includes first and second conductors; and an isolating resistor;

wherein a first end of said first conductor of said first transmission line of said second combiner section is coupled to said second end of said second conductor of said first transmission line of said first combiner section, and a first end of said first conductor of said second transmission line of said second combiner section is coupled to said second end of said second conductor of said second transmission line of said first combiner section;

wherein a second end of said first conductor of said first transmission line of said second combiner section is coupled to a first input of said isolating resistor of said second combiner section, and a second end of said first conductor of said second transmission line of said second combiner section is coupled to a second input of said isolating resistor of said second combiner section;

wherein a first end of said second conductor of said first transmission line of said second combiner section is coupled to said second input of said isolating resistor of said second combiner section, and a first end of said second conductor of said second transmission line of said second combiner section is coupled to said first input of said isolating resistor of said second combiner section; and wherein second ends of said second conductors of said first and second transmission lines of said second combiner section are coupled to said load.

5. An apparatus comprising:

a plurality of two-conductor coupled transmission lines, wherein each transmission line includes first and second conductors; and a plurality of input terminals corresponding to said plurality of transmission lines; and a plurality of resistors corresponding to said plurality of transmission lines;

wherein said first conductor of each of said transmission lines is connected at a first end to a corresponding input terminal and at a second end to a first input of a corresponding resistor, and a second conductor of each of said transmission lines is connected at a first end to a load and at a second end to a second input of said corresponding resistor.

6. An apparatus comprising:

first and second three-conductor coupled transmission lines, wherein each transmission line includes first, second and third conductors;

first and second input terminals; and first and second isolating resistors;

wherein a first conductor of said first transmission line is connected at a first end to said first input terminal and at a second end to a first input of said first isolating resistor, and a first conductor of said second transmission line is connected at a first end to said second input terminal and at a second end to a second input of said first isolating resistor;

wherein said second conductor of said first transmission line is connected at a first end to a first input of said second isolating resistor and at a second end to said second input of said first isolating resistor, and said second conductor of said second transmission line is connected at a first end to a second input of said second isolating resistor and at a second end to said first input of said first isolating resistor; and wherein said third conductor of said first transmission line is connected at a first end to said second input of said second isolating resistor and at a second end to a load, and said third conductor of said second transmission line is connected at a first end to said first input of said second isolating resistor and at a second end to said load.

* * * * *